US007128075B2

(12) United States Patent
Publ

(10) Patent No.: US 7,128,075 B2
(45) Date of Patent: Oct. 31, 2006

(54) PARTS WASHING APPARATUS

(75) Inventor: Rudy Publ, Glendale Heights, IL (US)

(73) Assignee: Safety-Kleen Systems, Inc., Plano, TX (US)

( * ) Notice: Subject to any disclaimer, the term of this patent is extended or adjusted under 35 U.S.C. 154(b) by 91 days.

(21) Appl. No.: 10/725,838

(22) Filed: Dec. 1, 2003

(65) Prior Publication Data

US 2005/0115593 A1 Jun. 2, 2005

(51) Int. Cl.
*B08B 3/00* (2006.01)

(52) U.S. Cl. ..... 134/107; 134/105; 134/147

(58) Field of Classification Search ..... 134/90, 134/105, 107, 108, 111, 114, 86, 56 R, 57 D, 134/147; 165/10, 159; 392/441, 447
See application file for complete search history.

(56) References Cited

U.S. PATENT DOCUMENTS

| | | | | |
|---|---|---|---|---|
| 2,057,177 | A | 10/1936 | Wolff | |
| 3,129,451 | A | 4/1964 | Colaianni | |
| 3,154,084 | A | 10/1964 | Mckee | |
| 4,170,240 | A | 10/1979 | Gentry | |
| 4,842,001 | A * | 6/1989 | O'Leary | 134/112 |
| 5,322,078 | A | 6/1994 | Tuttle | |
| 5,398,708 | A * | 3/1995 | Sheldon | 134/86 |
| 5,482,065 | A * | 1/1996 | O'Leary | 134/111 |
| 5,640,981 | A * | 6/1997 | Niemela et al. | 134/114 |
| 5,642,742 | A * | 7/1997 | Noren et al. | 134/57 D |
| 5,782,252 | A * | 7/1998 | Lewis et al. | 134/103.1 |
| 5,845,661 | A | 12/1998 | Leppo | |
| 6,115,541 | A * | 9/2000 | Rhodes | 392/441 |
| 6,128,438 | A * | 10/2000 | Kim | 392/447 |
| 6,131,525 | A | 10/2000 | Myers | |
| 2002/0017314 | A1 | 2/2002 | McClure et al. | |
| 2002/0074019 | A1 | 6/2002 | McClure et al. | |

* cited by examiner

*Primary Examiner*—Michael Barr
*Assistant Examiner*—Sarah E Husband
(74) *Attorney, Agent, or Firm*—Vedder Price Kaufman & Kammholz

(57) ABSTRACT

An apparatus for washing parts includes a cleaning chamber including a spray portion and a reservoir portion. The spray portion includes a support for the parts and a spray bar having at least one orifice for distributing a cleaning solution. The reservoir portion stores and collects the cleaning fluid. A thermal energy source adjusts and maintains the operating temperature of the cleaning solution in the reservoir portion. The thermal energy source retains a transfer fluid and includes a heater for adjusting a temperature of the transfer fluid. A conduit extends through the thermal energy source and defines a passageway for the cleaning fluid. A pump draws the cleaning fluid through the passageway and discharges the cleaning solution through the spray bar, such that the operating temperature of the cleaning solution is increased.

16 Claims, 5 Drawing Sheets

PARTS WASHING APPARATUS

FIELD OF THE INVENTION

The present invention relates generally to an apparatus for washing parts to remove greases, oils and dirt, and, in particular, to an apparatus for washing parts having an improved heating assembly for adjusting and maintaining the cleaning solution at an effective temperature during operation of the parts washing apparatus.

BACKGROUND OF THE INVENTION

A parts washer is an apparatus that cleans various parts including, but not limited to machinery and machine parts. Current parts washers generally use an aqueous cleaning solution to remove such things as grease, carbon, resins, tar, inks and other grime from dirty parts like engine parts, tools, etc. Parts washers have also been known to use hydrocarbon solvent cleaning solutions to clean parts.

A conventional automatic aqueous parts washer includes a housing with a door to access a cleaning chamber having tray disposed therein for supporting parts. A pump pulls a cleaning solution from a reservoir and delivers the cleaning solution under pressure to a series of nozzles directed toward the parts disposed on the tray. A heater disposed in the reservoir is also commonly used for increasing the temperature of the aqueous cleaning solution, when desirable.

A major disadvantage of conventional part washers is the inability of the heater to maintain the temperature of the aqueous cleaning solution in an effective range, i.e. 120° F. to 160° F. Aqueous cleaning solutions must be stabilized in the effective range during a cleaning cycle in order to properly clean parts. Conventional parts washers attempt to maintain the cleaning solution in the effective range by using a heater configured for the cleaning solution capacity and workload of the machine. Such conventional heating elements are usually immersion heaters in direct contact with the aqueous cleaning solution and when new, easily raise the temperature of the cleaning solution into the effective range. However, once parts washing has commenced, the cleaning solution temperature drops rapidly, usually in less than 5 minutes. The heating element at maximum rated output cannot maintain the temperature of the cleaning solution above 120° F., for any extended period of time which is required to clean parts effectively. The cleaning solution cools as a result of ambient losses to the surrounding environment, atomization of the cleaning solution as it exits the nozzles and heat energy dissipated into the parts to be cleaned to bring them up to solution temperature.

Another disadvantage, and basis for the above disadvantage, is that a significant majority of the conventional aqueous parts washers are sold and used in a commercial setting, such as a car dealership repair shop, or a residential setting. Standard 120 volt/single phase electrical circuits in commercial and residential settings are often limited to 15 amps. In rare instances a 20 amp circuit may be available. Usually, custom installation or retrofit of an 120 volt electrical circuit with power handling capability of more than 15 amps is necessary. This results in increased costs to the facility owner. Alternatively, 240 or 480 volts of single or multi-phase circuits may be installed, all at significant cost to the owner/operator. Moreover, parts washers designed to operate on increased capacity electrical circuits also cost more to manufacture. Accordingly, conventional parts washers cannot be modified to use additional heaters because the power capacity of the electrical circuits is limited.

Another disadvantage of prior art parts washers is that the immersion heater is in direct contact with the aqueous cleaning solution. During the parts washing process, sludge, scale and other particulates, which are common in aqueous cleaning solutions, accumulate and are baked on the heater elements resulting in buildup of scale deposits on the heater. The scale deposits then act as an insulator. As a result, over time, heat transfer to the cleaning solution becomes less efficient, energy/operating costs are increased, life expectancy of the heater elements is shorter and periodic maintenance is increased.

Therefore, there is a need in the art for an improved parts washing apparatus having a novel structure and function for adjusting, increasing and maintaining the temperature of an aqueous cleaning solution that is operational on a standard 120 volt/15 amp electrical circuit, requires substantially reduced maintenance and less operating energy, cleans longer and more batches of parts compared to conventional parts washers, and overcomes the aforementioned disadvantages of prior art parts washers.

BRIEF DESCRIPTION OF THE DRAWINGS

The invention may be best understood by reference to the following description taken in conjunction with the accompanying drawings, in the several figures of which like reference numerals identify like elements.

DETAILED DESCRIPTION OF A PREFERRED EMBODIMENT OF THE INVENTION

Briefly, in one embodiment of the present invention, an apparatus for washing parts includes a housing defining a cleaning chamber including a spray portion in a reservoir portion. The spray portion includes a support for the parts and a spray bar having at least one orifice for distributing a cleaning fluid on the parts. The reservoir portion is configured to store and collect the cleaning fluid. A thermal energy source is disposed in the reservoir portion for adjusting and maintaining an operating temperature of the cleaning fluid. The thermal energy source preferably increases the temperature of the cleaning solution. The thermal energy source is generally configured as an enclosure having a plurality of walls for retaining a transfer fluid and includes at least one heater disposed therein for adjusting a temperature of the transfer fluid. A conduit extends through the thermal energy source in contact with the transfer fluid and defines a passageway for the cleaning fluid. A pump draws the cleaning fluid in the reservoir portion through the passageway and discharges the cleaning fluid through the spray bar. The operating temperature of the cleaning fluid is adjusted and maintained by contact with the thermal energy source and the conduit. Use of the term adjust may mean to increase or maintain the temperature of any fluid.

Figure 1:
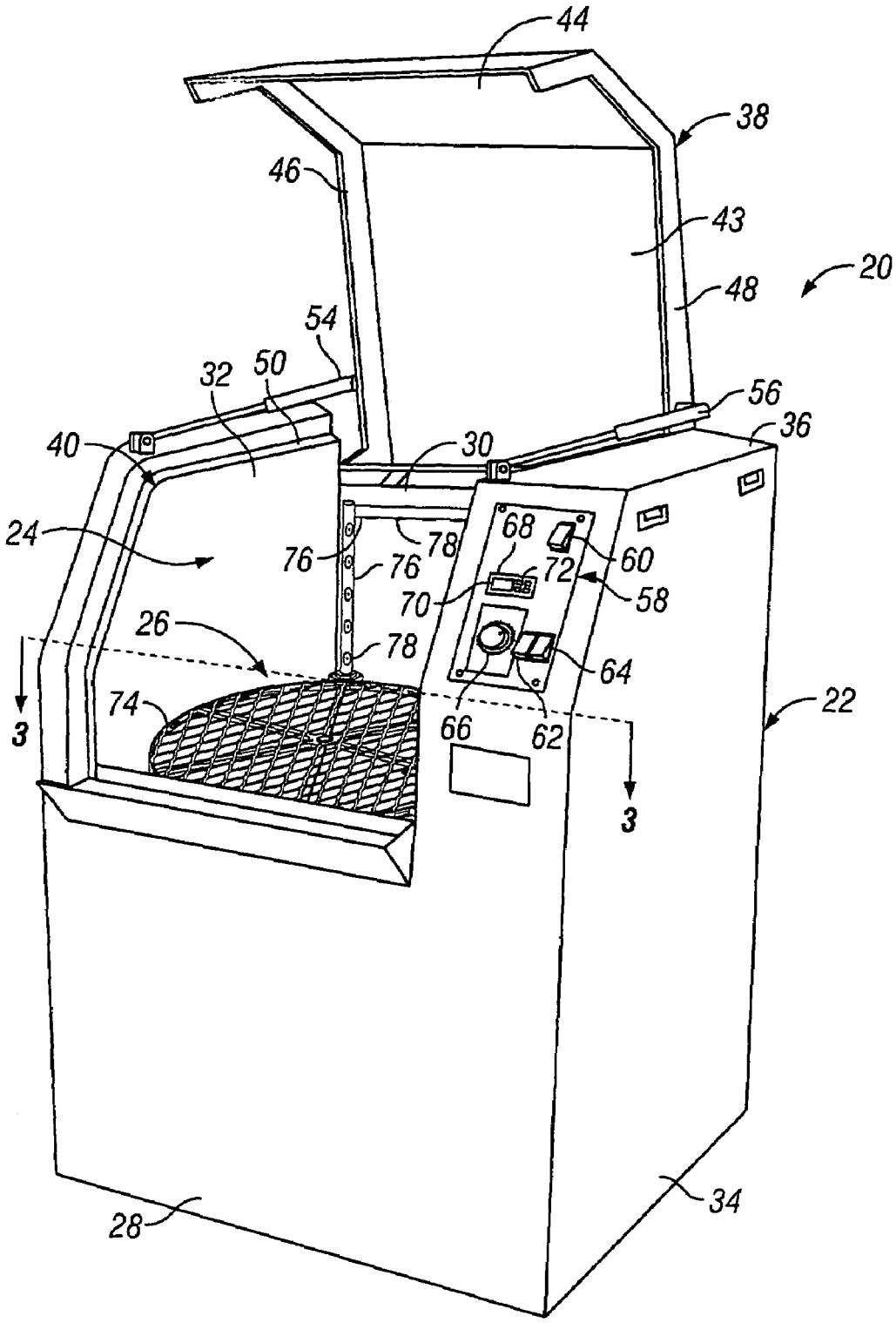
FIG. 1 is a perspective view of a parts washing apparatus in accordance with one embodiment of the present invention.
Figure 2:
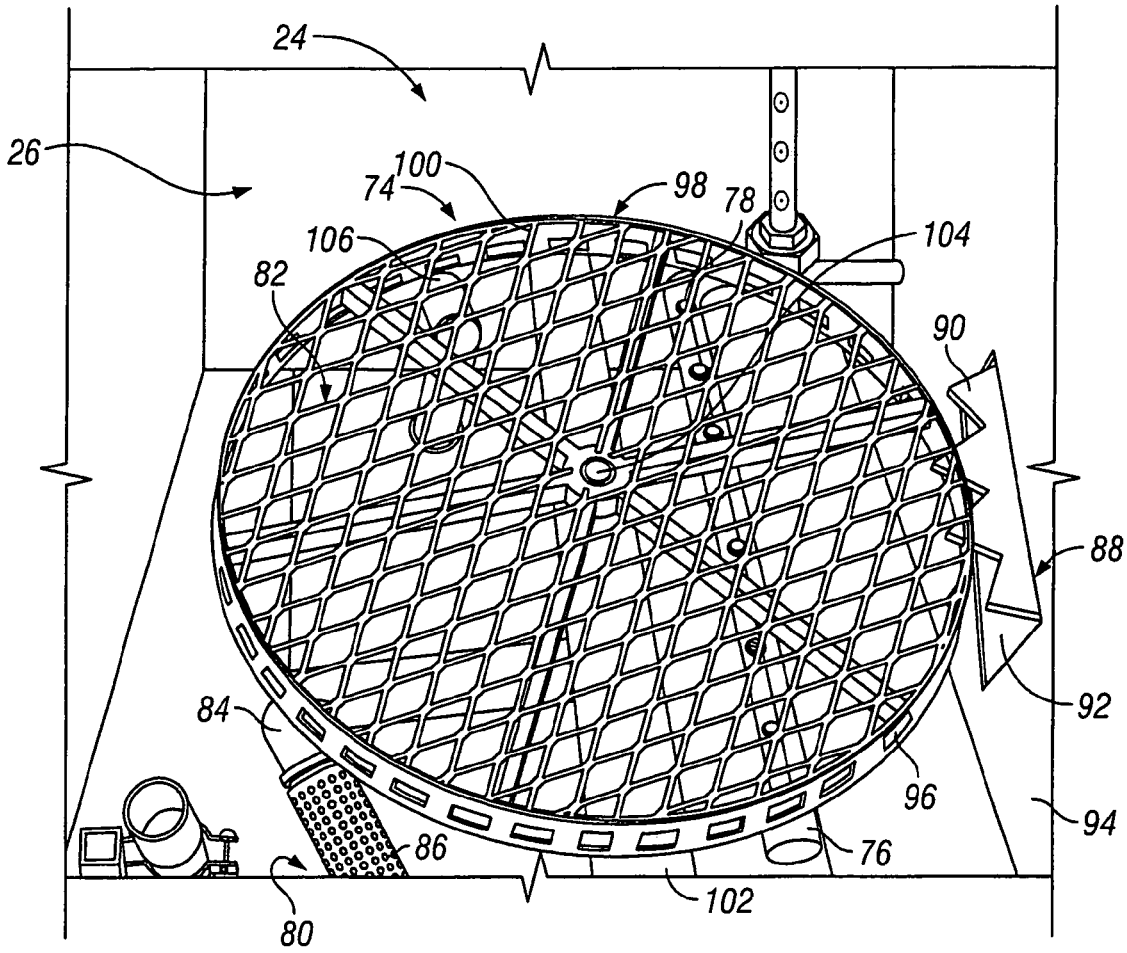
FIG. 2 is a detailed view of a portion of a cleaning chamber of the parts washing apparatus of FIG. 1.
Figure 3:
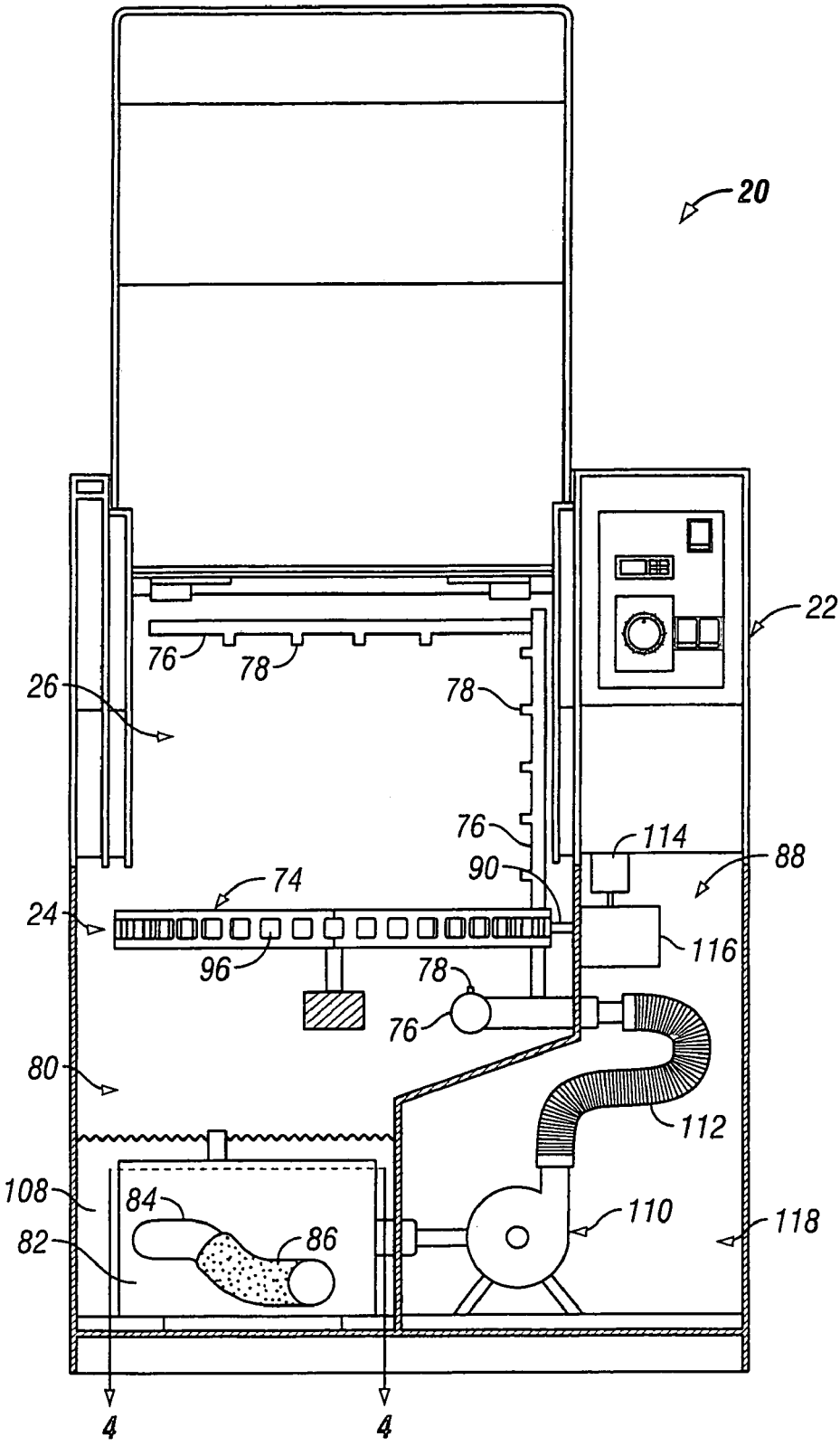
FIG. 3 is a cross sectional view of the parts washing apparatus of FIG. 1 taken along line 3—3.

Referring to FIG. 1, an apparatus for washing parts is designated generally by reference 20. In one embodiment of the present invention, the apparatus for washing parts 20 includes a housing 22, which defines a cleaning chamber 24 including a spray portion 26 and a reservoir portion (as best shown in FIGS. 2 and 3). The housing 22 includes a plurality of walls, including a front wall 28, a back wall 30, opposing side walls 32, 34 and a top wall 36. A lid 38 is movably connected to the rear wall 30. The lid 38 is movable from a first operative position, i.e. closed (not shown), to a second operative position, i.e. open (as shown FIG. 1), in order to reveal an opening 40 to the cleaning chamber 24. The apparatus is not operational in the second operative position (i.e. open). The lid 38 includes a top portion 42 and a front portion 44. Opposing side portions 46, 48 overlap mechanical seals 50 in order to seal the cleaning chamber 24. Struts 54, 56 are connected to the top wall 36 and each of the opposing side portions 46, 48 in order to dampen movement of the lid 38 between first and second operative positions.

A control panel 58 is provided on the front panel 28. The control panel 58 includes a plurality of controls, including a heater on/off switch 60, a circuit breaker for a turntable 62, a circuit breaker for the electrical control circuit and a wash cycle timer 66. A temperature controller 68 includes a display 70 and a plurality of input buttons 72. Operation of the temperature controller 68 will be described in detail below.

The spray portion 26 includes at least a support 74 and a spray bar 76. The support 74 is generally configured as a turntable upon which parts to be washed are placed. The turntable is moved relative to the spray bar 76 in order to wash the parts. The spray bar 76 includes at least one orifice 78 for distributing a cleaning solution on the parts (not shown). It will be understood by those of skill in the art that the spray bar 76 may include a plurality of arms. Each arm has a plurality of orifices 78, which may each be generally configured as a nozzle. For example, the spray bar 76 may include a first portion disposed below the support (as shown in FIGS. 2 and 3) and at least one portion that extends above the support 74. The at least one portion that extends above the support may also include a vertical component and a horizontal component. Further, at least one arm of the spray bar 76 may be movable with respect to the other arms in order to provide desired parts washing coverage. A plurality of orifices and/or nozzles 78 are provided on each arm of the spray bar 76.

Referring now to FIG. 2, a detailed broken-away view of the cleaning chamber 24 is illustrated. The spray portion 26 is disposed above the reservoir portion 80 such that the reservoir portion 80 is configured to store and collect the cleaning fluid (see FIG. 3).

A thermal energy source 82 is disposed in a reservoir portion 80 for adjusting and maintaining an operating temperature of the cleaning solution. (see FIG. 3). The thermal energy source 82 is generally configured as an enclosure for retaining a transfer fluid (not shown) and including at least one heater 130, 132 (see FIG. 4) for adjusting and maintaining a temperature of a transfer fluid to a set point and likewise, the cleaning solution as will be described in more detail below. An inlet strainer 86 is connected to a pick-up tube 84, which is connected to a conduit (see FIG. 4) that extends through the thermal energy source 82. The thermal energy source 82 may further include a vent 106 to the desired location.

A drive mechanism 88 rotates the turntable. In one embodiment, the drive mechanism includes a gear 90, which extends through an opening 92 in the inner side wall 94, which further defines the cleaning chamber 24. The teeth on the gear 90 engage apertures 96, formed in an outer ring 98 of the support 74. It is within the teachings of the present invention that any other suitable drive mechanism and other corresponding structure may be used. The top surface of the support 74 includes an expanded metal grate 100, or other suitable material, which passes over the spray bar 76, and a plurality of orifice nozzles 78 provided thereon. A central beam 102 supports the center 104 of the support 74 for movement thereabout.

FIG. 3 is a cross-section view of the apparatus 20 of FIG. 1 taken along line 3—3. The cleaning chamber 24 includes a spray portion 26 disposed above a reservoir portion 80. A cleaning solution 108 is stored in the reservoir portion 80 and is collected therein after discharge from the spray bar 76. The cleaning solution 108 may be one of aqueous-based or another suitable cleaning solution. It will be recognized by those of skill in the art that the present invention may be operated in connection with any suitable cleaning fluid that corresponds with the cleaning requirements as desired.

A pump 110 draws the cleaning solution 108 in the reservoir portion 80 through the inlet strainer 86, pick-up tube 84 and thermal energy source 82. The cleaning solution is then discharged through the spray bar 76 and the nozzles 78 thereon. As will be described in more detail below, the thermal energy source 82 adjusts and maintains the temperature of the cleaning solution 108 as the cleaning solution 108 is collected and stored in the reservoir portion 80 through contact with an exterior of a wall of the thermal energy source, and flash heats or rapidly transfers heat energy to the cleaning solution 108 which passes through the conduit of the thermal energy source. A flexible line 112 may be used to connect the pump 110 to the spray bar 76 in order to ease manufacturing of the apparatus 20.

The drive mechanism 88 includes a motor 114, which drives a gear 90 that engages the apertures 96 of the support 74, as described above. A shield 116 houses the gear 90 and prevents the cleaning solution 108 from entering the equipment portion 118 of the housing 22 when the cleaning solution 108 is discharged from the nozzles 78.

Figure 4:
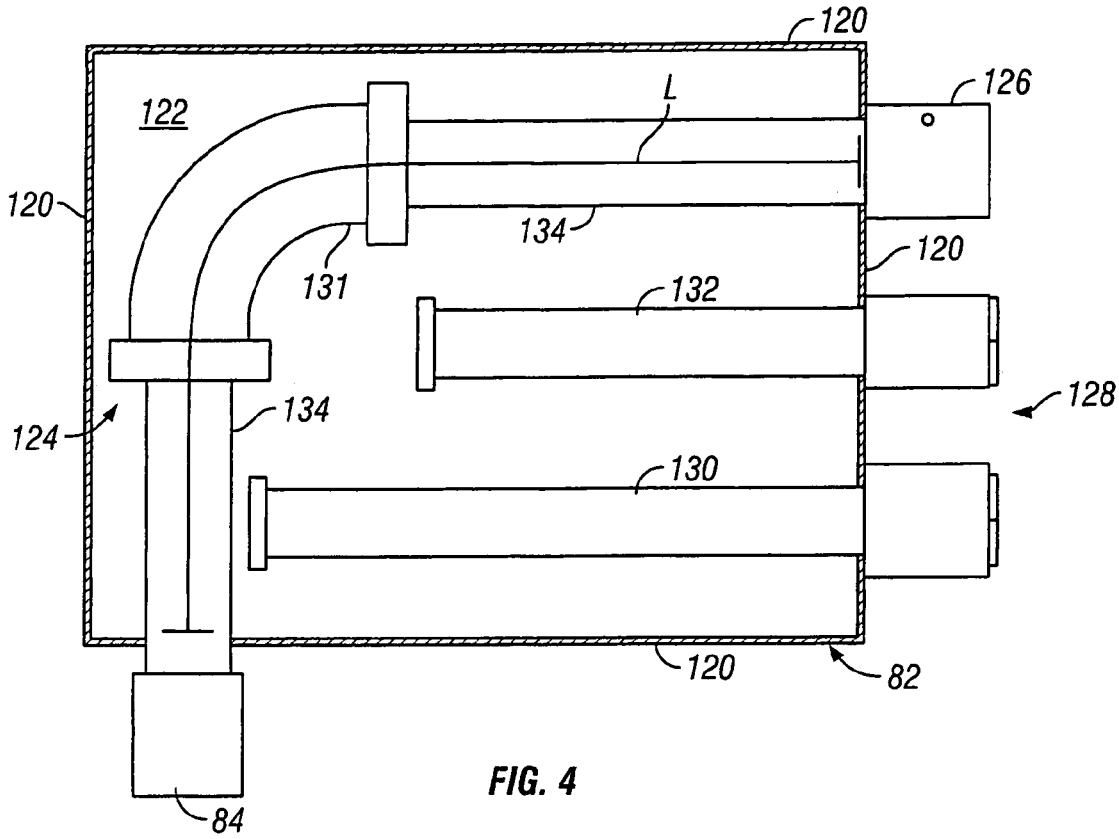
FIG. 4 is a detailed cross-sectional view of a thermal energy source disposed in the cleaning chamber of FIG. 3 taken along line 4–4.

FIG. 4 is a detailed cross-section view of a thermal energy source 82 disposed in the cleaning chamber of FIG. 3 taken along line 4—4. The thermal energy source 82 is generally configured as an enclosure for retaining a transfer fluid (not shown). The enclosure includes a plurality of walls 120, a bottom 122 and a top (which has been removed to facilitate disclosure). An exterior of at least one wall is in heat transfer contact with the cleaning solution. Preferably, at least three wall exteriors are in heat transfer contact with the cleaning solution. The pick-up tube 84 is connected to a conduit 12 that extends through the thermal energy source 82 in contact with the transfer fluid (not shown) and defies a passageway for the cleaning solution. A fitting 126 on an end of the conduit 124 opposite the inlet tube 84 is adapted for connection to a tube from the pump.

The thermal energy source 82 further includes at least one heater 128. Preferably, the at least one heater 128 includes a primary heater 130 and a secondary heater 132. The primary and secondary heaters 130, 132 are preferably activated simultaneously, as will be discussed in more detail below, to initially raise the temperature of the transfer fluid to a set point whereby the cleaning solution temperature is raised to a desired set point, preferably within the effective range of the desired cleaning solution. The heat transfer fluid (not shown), as a result of its molecular structure, typically can be heated at a much faster rate than water or the cleaning solution when applying the equivalent amount of energy. As a result, initial start-up and operational recovery temperature adjustments are made more rapidly.

At least one heater element 128 is operational during a wash cycle. After the primary and secondary heaters 130, 132 have initially increased the temperature of the cleaning solution to the desired set points, one of the heaters 128 continues to input energy into the transfer fluid so that the temperature of the transfer fluid is near its desired set point and the thermal energy source continues to transfer heat to the cleaning solution as it cools off during a cleaning cycle.

The conduit 124 has a length L and includes a wall 134, which has a heat transfer surface area adequate to raise the operating temperature of the cleaning solution drawn thereto generally near the cleaning solution set point. Preferably, the temperature differential between the transfer fluid (not shown) and cleaning solution is sufficiently large such that the cleaning solution may also be subject to flash-heating while passing through the conduit. As shown, and in one embodiment of the present invention, the conduit 124 extends between adjacent walls 120 and intersects each of the walls normally. Preferably, the conduit 124 has a length L approximate equivalent to a distance of one-half the perimeter of the enclosure.

Figure 5:
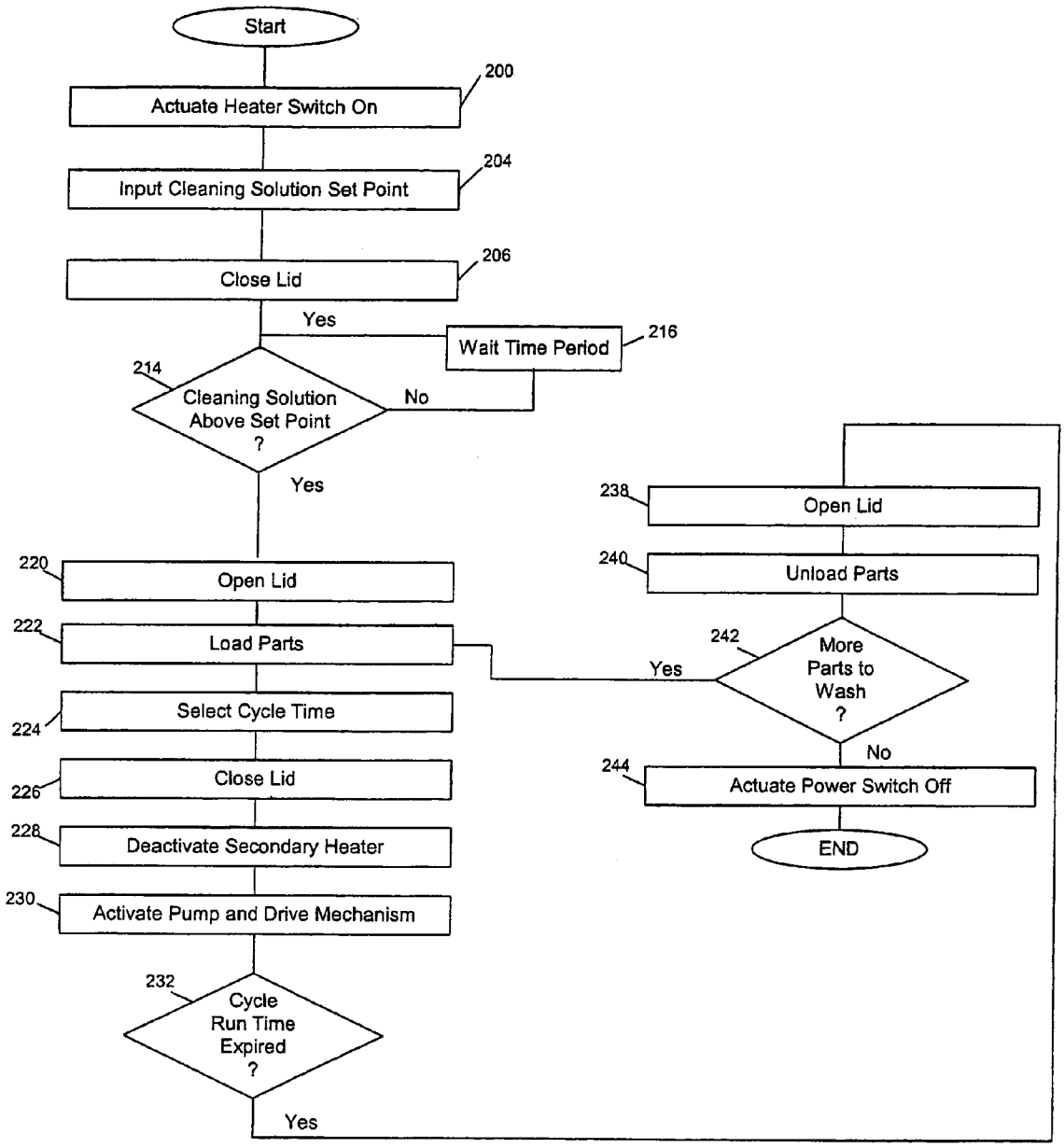
FIG. 5 illustrates a flow chart representing the steps of operation of the parts washing apparatus of FIG. 1 in accordance with one embodiment of the present invention.

FIG. 5 illustrates a flow chart representing the steps of operation of the parts washing apparatus of FIG. 1 in accordance with one embodiment of the present invention. It will be understood by those of skill in the art that the apparatus is connected to an appropriate power supply and that the cleaning solution is present in the reservoir portion of the cleaning chamber. In step 200, an operator actuates the heater on/off switch to activate the primary and secondary heater elements. In step 204, the operator inputs a cleaning solution temperature set point to the controller. In step 206, the operator may close the lid of the apparatus. In step 214, the controller evaluates whether the cleaning solution is above the set point. This may be accomplished by a temperature sensor in contact with the cleaning solution which generates a signal representative thereof which is read by the controller. Other suitable structure and function may be used. If the cleaning solution temperature is not above the set point temperature, then the controller waits a predetermined period of time before reevaluating. If the cleaning solution temperature is above the set point temperature, then the parts cleaner is ready for cleaning parts.

The apparatus may remain in this ready state until the operator is prepared to wash parts. While in this ready state, the controller continues to maintain the transfer fluid and the cleaning solution temperatures at the desired set points. When parts are ready to be washed, the operator opens the lid in step 220. The operator may then load parts in step 222. In step 229, the operator selects a cycle time. Upon closing the lid in step 226, the controller deactivates the secondary heater in step 228 and activates the pump and drive mechanism in step 230. The apparatus cycle run time continues until expired in step 232. When the event cycle run time has expired, the operator may then open the lid in step 238 and unload the parts in step 240. In the event there are more parts to wash in step 242, the operator closes the lid in step 206 and resumes the subsequent process. If there are no more parts to wash, the operator may actuate the heater switch off in step 244.

Various modifications and changes may be made by those skilled in the art without departing from the true spirit and scope of the invention, as defined by the depending claims. For example, the apparatus may be configured to operate with the advantages described herein with respect to 240 volt/single-or three-phase or 480 volt/three-phase electrical circuits.

What is claimed is:

1. An apparatus for washing parts comprising:

a housing defining a unitary cleaning chamber including a spray portion and a reservoir portion;

the spray portion including a rotatable support for the parts and a spray bar having at least one orifice for distributing a cleaning solution on the parts as the support is rotated relative to the spray bar;

the reservoir portion configured to store and collect the cleaning solution;

a thermal energy source disposed wholly within the cleaning solution disposed in the reservoir portion for adjusting and maintaining an operating temperature of the cleaning solution;

the thermal energy source generally configured as an enclosure for retaining a transfer fluid and including at least one heater for adjusting a temperature of the transfer fluid and a plurality of walls;

a conduit extending through the thermal energy source in contact with the transfer fluid and defining a passageway for the cleaning solution; and a pump disposed in the housing outside the cleaning chamber for drawing the cleaning solution in the reservoir portion first through the passageway and then discharging the cleaning solution through the spray bar, wherein when first drawn through the passageway by the pump, the operating temperature of the cleaning solution is increased, as a result of contact with the conduit that has been heated by the transfer fluid.

2. The apparatus as recited in claim 1, wherein the housing further includes a lid moveable from a first operative position to a second non-operative position in order to reveal an opening to the cleaning chamber.

3. The apparatus as recited in claim 1, wherein the spray bar includes a first portion disposed below the support, a second portion that extends above the support and orifices on each of the first and at least one second portions.

4. The apparatus as recited in claim 1, wherein the at least one orifice is generally configured as a nozzle.

5. The apparatus as recited in claim 1, wherein the cleaning solution is aqueous-based.

6. The apparatus as recited in claim 1, wherein the enclosure includes a plurality of walls, a bottom and a top.

7. The apparatus as recited in claim 1, wherein the thermal energy source includes a primary heater and a secondary heater.

8. The apparatus as recited in claim 7, wherein the secondary heater is deactivated when the pump is activated.

9. The apparatus as recited in claim 1, wherein the conduit has a length and includes a wall having a heat transfer surface area adequate to raise the operating temperature of the cleaning fluid drawn there through generally near the set point.

10. The apparatus as recited in claim 1, wherein the apparatus further includes a controller for cycling activation of the at least one heater based on the set point and the operating temperature.

11. The apparatus as recited in claim 1, wherein the support is configured as a turntable to move the parts thereon relative to the spray bar.

12. The apparatus as recited in claim 1, wherein the apparatus further includes a cycle timer, which activates the pump for a desired period when a lid is disposed in a first operative position.

13. The apparatus as recited in claim 11, wherein a drive mechanism is activated to rotate the turntable when a lid is moved from a second non-operative position to a first operative position.

14. The apparatus as recited in claim 1, wherein the conduit extends between adjacent walls of the enclosure and intersects each of the walls normally.

15. The apparatus as recited in claim 1, wherein the conduit has a length approximate to one-half a perimeter of the enclosure.

16. The apparatus as recited in claim 1, wherein the apparatus is operable at a standard voltage of 120 volts and current of 15 amps.

* * * * *